US007227308B2

(12) United States Patent
Rense

(10) Patent No.: US 7,227,308 B2
(45) Date of Patent: Jun. 5, 2007

(54) ASSEMBLY FOR PRECISION FOCUS OF COMPACT PAR LAMPS

(75) Inventor: Mark S. Rense, Lyndhurst, OH (US)

(73) Assignee: General Electric Company, Schenectady, NY (US)

( * ) Notice: Subject to any disclaimer, the term of this patent is extended or adjusted under 35 U.S.C. 154(b) by 189 days.

(21) Appl. No.: 10/720,355

(22) Filed: Nov. 24, 2003

(65) Prior Publication Data

US 2005/0112982 A1 May 26, 2005

(51) Int. Cl.
*H01J 17/18* (2006.01)
*H01J 61/36* (2006.01)

(52) U.S. Cl. ..... 313/623; 313/238; 313/269; 313/50; 313/624

(58) Field of Classification Search ..... 313/318.11, 313/318.01, 318.09, 623–625, 49–51, 638
See application file for complete search history.

(56) References Cited

U.S. PATENT DOCUMENTS

| | | | | |
|---|---|---|---|---|
| 4,181,869 | A | 1/1980 | Warren et al. | |
| 5,466,981 | A | 11/1995 | Fields et al. | |
| D379,538 | S | 5/1997 | Gallant | |
| D398,407 | S | 9/1998 | O'Connell et al. | |
| 6,060,820 | A * | 5/2000 | Noll et al. | 313/113 |
| 6,078,128 | A * | 6/2000 | Gagnon et al. | 313/113 |
| 6,147,444 | A | 11/2000 | Gallant et al. | |
| 6,210,029 | B1 * | 4/2001 | Noll et al. | 362/549 |

* cited by examiner

*Primary Examiner*—Mariceli Santiago
(74) *Attorney, Agent, or Firm*—Fay Sharpe LLP

(57) ABSTRACT

A lamp includes a reflector including a reflective portion, a heel, and a nose, wherein the nose includes an opening. A light source is disposed in the reflector. A pair of leads connects to the light source. An eyelet protrudes through the opening in the nose and receives one of the leads. A positioning member is disposed in the heel portion of the reflector. The positioning member includes an opening to receive the light source.

18 Claims, 2 Drawing Sheets

ASSEMBLY FOR PRECISION FOCUS OF COMPACT PAR LAMPS

BACKGROUND OF THE INVENTION

This invention relates to electric lamps. More particularly the invention relates to electric lamps where a filament of the lamp is aligned with a focal point of a reflector.

PAR type lamps operate most efficiently when a filament coil of a light source is in a known position relative to the focal point of the reflector of the lamp. Known methods to fix the location of the light source and thus the filament relative to the reflector (or reflector housing) include using an insulating spacer and ceramic adhesives. This assembly technique is process intensive and results in filament tube reliability issues due to cement transfer onto a pinched end of the light source and mislocation of a heat shield, which can cause thermal cycle oxidation failures. Quality issues such as deviation from desired beam pattern, center beam intensity, and lumen output can also be prevalent with this type of fixing system.

An alternative method of fixing the location of the light source uses a metal disc in conjunction with metal eyelets. In this method, to assemble the lamp, a light source is inserted into an opening of a positioning member that is placed in engagement with a ledge of a protrusion. Thereafter, a force is applied to positioning member so as to deform it slightly rearwardly. After the force is applied to the positioning member a pair of eyelets are then mechanically fastened to the leads that will retain the deformation of the positioning member. After a period of time the assembly will "relax" so that a force remains on the positioning member.

Another alternative uses two metal eyelets crimped tightly to the base of the reflector housing. This alternative is highly dependent upon small variations and the conditions of openings in the base of the glass reflector. Furthermore, no positioning member is provided to facilitate positioning the light source in the reflector housing. Consequently, fixing the filament coil of the light source in a known position relative to the focal point of the reflector is difficult.

BRIEF DESCRIPTION OF THE INVENTION

A lamp includes a reflector, a light source, a positioning member, and first and second eyelets. The reflector includes a reflective portion, a heel portion, and a nose where the nose includes an opening extending therethrough. The light source and positioning member are disposed at a desired location in the reflector. The positioning member includes an opening that receives the light source. A pair of leads extend from the light source where they are received in respective eyelets. The eyelets protrude through the opening in the nose of the reflector.

A method of manufacturing a lamp comprising a reflector, a light source disposed in the reflector, a pair of leads connected to the light source, an eyelet protruding through an opening in a nose of the reflector and a positioning member disposed in the heel portion of the reflector is provided. The method includes the steps of positioning a portion of the light source inside an opening in the positioning member. The method further includes inserting the eyelet into the opening in the nose such that a portion of the eyelet extends from each side of the nose. The method further includes deforming the eyelet such that the eyelet is fixed in the opening of the nose. The method also includes inserting the light source into the reflector such that at least one lead protrudes through the eyelet.

DETAILED DESCRIPTION OF THE INVENTION

Figure 1:
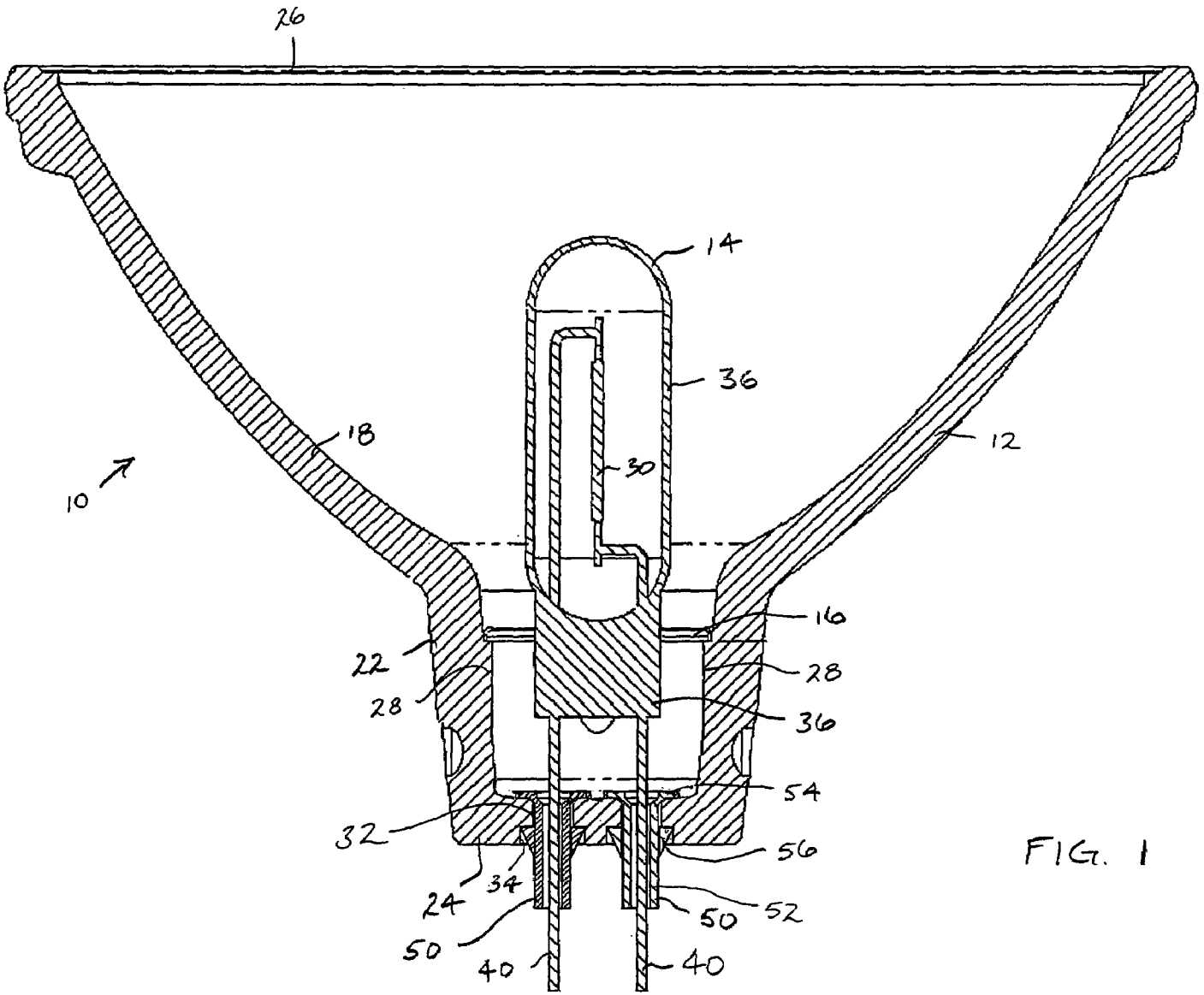
FIG. 1 is a schematic cross-sectional view of a lamp.

Referring to FIG. 1, a lamp or electric lamp 10 includes a reflector housing 12, a light source 14, and a positioning member 16. The lamp in the preferred arrangement comprises a conventional halogen PAR type lamp. The lamp can alternatively be a conventional incandescent lamp, as well as other conventional lamps.

The reflector housing 12 is made of glass and provides an enclosure for the light source 14. The reflector housing is coated with a reflective coating. The reflector housing includes a reflective portion 18, along at least an inner surface thereof and is preferably a highly reflective material such as an aluminum layer, although other reflective surfaces such as a dichroic material can be used without departing from the scope and intent of the present invention. The reflective portion 18 typically has a concave or parabolic shape, although it is contemplated that the reflector housing could adopt a different contour or shape such as an elliptical or other known shape or combination of shapes. The reflector housing further includes a heel portion 22 and a nose 24. The heel portion 22 depends axially outwardly from a central portion of the reflective portion 18 and has a substantially cylindrical configuration. The nose 24 is circular and extends from and closes off the heel portion 22. A lens cover 26 encloses the reflector housing 12 along the outer circumference of the housing.

The heel portion 22 attaches to a lamp base (not shown) such as an Edison base, as just one example. Details of such arrangements are well known in the art so that further discussion herein is unnecessary. The heel portion 22 includes a plurality of radial shoulders 28 positioned on the inside of the heel portion 22. Four shoulders are provided at 90° apart from one another; however, a fewer or greater number of shoulders can be provided. The shoulders 28 support the positioning member 16 above the nose 24. The shoulders extend a predetermined height above the nose to position a filament 30 of the light source 14 in proper vertical relation to the focal point of the reflective portion 18 of the reflector housing 12. The shoulders 28, in conjunction with the positioning member 16, position the filament axially and diametrically with respect to the focal point of the reflective portion.

The nose 24 includes axially extending openings 32. The openings 32 proceed from an inner surface of the nose where the openings communicate with an inner cavity of the lamp toward a stepped region or a countersunk region 34 on an outer surface of the nose 24. In another embodiment, the openings 32 can be tapered. The light source 14 includes the filament 30, a light transmissive envelope or bulb 36 and a crimped end 38. The light source can be a conventional incandescent light source, but could also be a tungsten halogen light source or arc discharge light source. Leads 40 extend from the light source 14 to attach to the Edison or other type base (not shown).

As mentioned earlier, the positioning member 16 rests on the radial shoulder(s) 28. The shoulder dimension and the outer dimension (diameter) of the positioning member are closely matched to accurately locate the positioning member inside of heel portion 22 and thus relative to the reflector housing. This in turn, assures accurate location of the light source relative to the focal point of the reflector housing as will become more apparent below. The positioning member is preferably made of aluminum, however in an alternative embodiment the positioning member can be made from another suitable material, usually a metal. Since the positioning member 16 need not be placed in tension when inserted in the reflector housing the positioning member 16 can be made of aluminum. The aluminum positioning member 16 prevents tarnishing and facilitates the reflection of radiant energy, thus providing an additional heat shielding function as well as maximizing light output from the lamp.

Figure 2:
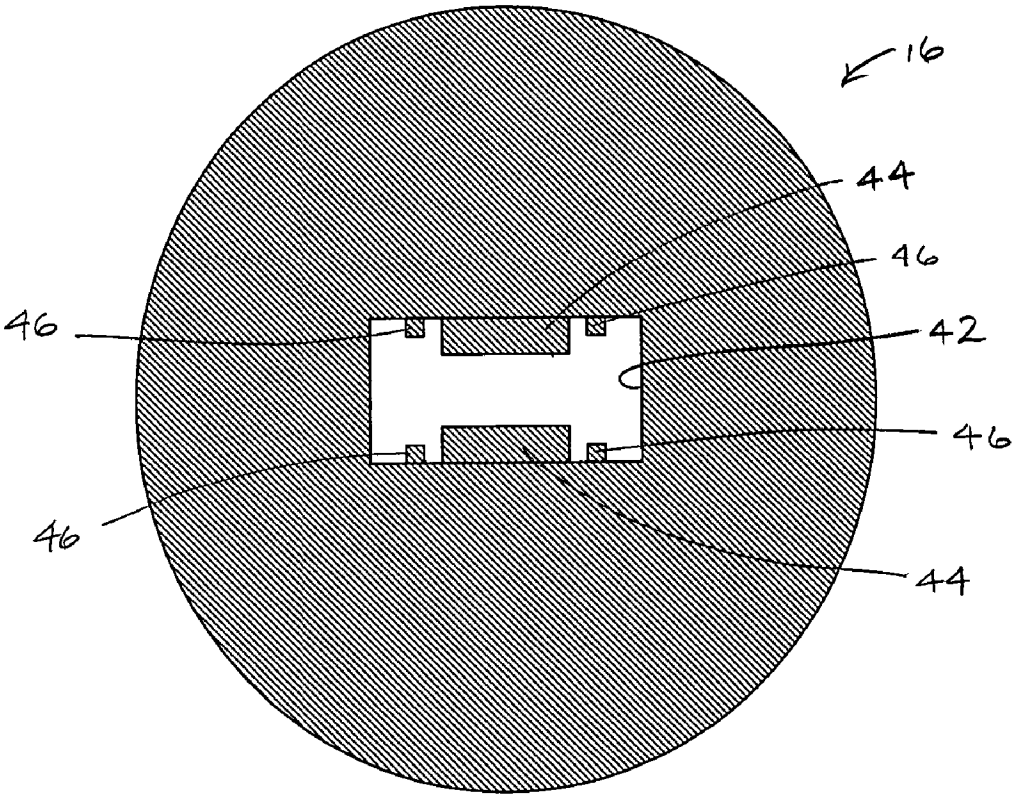
FIG. 2 is a plan view of a positioning member of the lamp of FIG. 1.
Figure 3:
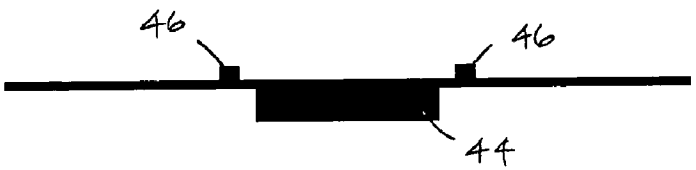
FIG. 3 is a side elevation view of the positioning member of FIG. 2.

The positioning member 16 includes an opening 42 (FIG. 2). The opening 42 is positioned in the positioning member 16 to axially, diametrically and vertically align the filament 30 of the light source 14 with the focal point of the reflective portion 18 of the reflector housing 12. The positioning member includes two central tabs 44 preferably disposed on opposite sides of the opening and four additional, smaller tabs 46 spaced outwardly from the central tabs. Particularly, two outer tabs 46 are located on one side of the opening 42 on opposite sides of the central tab 44. Two additional tabs 46 are located across from the first two outer tabs on an opposite side of the opening 42 and on an opposite side of the other central tab 44. In the embodiment depicted, the central tabs 44 depend axially outward (downwardly) from the positioning member 16 (FIG. 3) and the outer tabs 46 project axially outward in the opposite direction (upwardly) from the positioning member. The opening 42 receives the crimped end 38 of the light source 14. The central tabs 42 engage, through spring action, the crimped end 38 of the light source 14 when the light source is received by the opening 42. The outer tabs 46 cradle the bulb 36 of the light source 14 spacing and accurately locate the bulb 36 in relation to the positioning member 16. In this manner, the light source is precisely positioned relative to the focal point of the reflector housing.

Eyelets 50 are positioned in the openings 32 of the nose 24. The eyelets in the preferred embodiment are made of 70/30 brass; however, the eyelets can be made of any other suitable material. The eyelets include a tubular portion 52 and a flanged portion 54. In a preferred embodiment, the tubular portion 52 has a generally constant thickness and homogenous strength characteristic throughout the tubular portion for ease of manufacture. The flanged portion 54 is, for example, a rolled over portion of the tubular portion 52. The eyelets 50 are received in the openings 32 from the inside of the heel portion 22 and a segment of the tubular portion 52 of each eyelet extends a distance from the outside surface of nose 24. The flanged portion 52 seats on the inner surface of nose 24. As best illustrated in FIG. 1, the flanged portion 54 is dimensioned from abutting engagement with the inner surface of the nose 24 at the inner end of opening 32 by inserting the eyelets from within the reflector housing, through the heel portion, and into respective openings in the nose. In an alternative embodiment, the flanged portion can be received in a countersunk region or shoulder at the inner end of the opening 32. Upon insertion into the openings 32 the tubular portion 52 of the eyelet extending from the outer surface of nose 24 is deformed, i.e. swaged, to form a radial shoulder or upset portion 56 to mechanically fasten the eyelet 50 to the outer surface of the nose 24. The upset portion 56 engages the countersunk region 34 to keep the eyelet stable before and after the lead is inserted into the eyelet. The upset portion 56 sitting in the countersunk region aligns the eyelet in the two perpendicular axes of the nose 24 and axially limits any movement of the eyelet in the opening 32. In other words, the eyelet after being swaged is locked in three mutually perpendicular axes. The upset portion 56 of the eyelet also provides a larger surface area engaging the nose 24, lessening any likelihood that the eyelet 50 might come loose due to thermal cycling. The flanged portion 54 can also be deformed to further mechanically fasten the eyelet 50 to the nose 24 if desired. Preferably deformation of the eyelet does not affect the inside diameter of the opening extending axially through the eyelet.

To assemble the lamp 10, the eyelets 50 are inserted into the openings 32 in the nose 24 from inside the reflector housing 12. The eyelets are received such that the flanged portion 54 rests on the inner surface of the nose 24 that faces the reflective portion 12 of the lamp 10. A portion of the tubular portion 52 of the eyelets 50 protrudes outwardly from the openings 32 on an opposite side of the nose 24 from the reflective portion 18 of the reflector housing 12. The eyelet flanged portion 54 engages the nose 24 of the reflector housing 12. Deforming the tubular portion 52 forms a swaged portion 56 that engages a side of the opening 32 in the nose 24.

The light source 14 is inserted through the positioning member 42 by pressing the crimped seal region 38 of the bulb 36 into tight, biased engagement with the positioning member. Specifically, the crimped region 38 of the light source is suitable and advantageously cradled by outer tabs 46 extending from one side of the positioning member 42 and by central tabs 44 extending from the other side. This subassembly comprising the light source 14 and the positioning member 42 is then inserted into the reflector 12 such that each of the leads 40 protrude through a respective one of the eyelets 50. The positioning member 16 rests on the shoulders 28 in the heel portion 22 of the housing 12. The positioning member 16 need not be placed in tension and rests on the shoulder with no greater force than the weight of the positioning member and the light source. The eyelets 50 are then crimped to mechanically fasten the leads 40 within the eyelets 50. The eyelets are then preferably brazed to further mechanically fasten the eyelets 50 to the leads 40. Other conventional techniques can be used to attach the leads to the eyelets. Such a method properly positions the light source 14 in relation to the focal center of the reflector 12.

By providing a countersink 34 in the nose 24, and deforming/swaging the eyelets to provide a secure engagement therewith, a more compact arrangement is achieved. The swaged shoulder 56 locks the eyelets to the reflector housing without placing the assembly in tension. Subsequently crimping and brazing the eyelets to the leads 40 provides a secure connection during assembly and that is resistant to issues associated with thermal cycling.

While the lamp has been described with respect to specific embodiments by way of illustration, many modifications and changes will occur to those skilled in the art. It is, therefore, to be understood that the appended claims are intended to cover all such modifications and changes as fall within the scope and spirit of the claims.

What is claimed is:

1. A lamp comprising:

a reflector housing including a reflective portion, a heel portion and a nose, wherein the nose includes an opening;

a light source disposed in said reflector housing;

a pair of leads connected to said light source;

an eyelet protruding completely through the opening in the nose and receiving one of said leads, said eyelet includes a tubular portion and a flange, wherein the tubular portion comprises a wall having a substantially uniform thickness from the first end to the second end and having substantially homogenous strength characteristics throughout the length of the tubular portion; and a positioning member disposed in the heel portion of said reflector, said positioning member including an opening, the opening receiving said light source.

2. The lamp of claim 1, further comprising a shoulder protruding inwardly from a wall of the heel portion, wherein said positioning member rests on said shoulder.

3. The lamp of claim 2, wherein said positioning member rests on said shoulder with no greater force than the weight of said positioning member, and said light source.

4. The lamp of claim 1, wherein the opening in the nose has a first diameter at a surface of the nose facing the reflective portion and a second larger diameter at a surface facing away from the reflective portion.

5. The lamp of claim 1, wherein said eyelet includes a swaged portion engaging said nose.

6. The lamp of claim 1, wherein said positioning member includes a pair of tabs positioned on opposite sides of the opening in the positioning member, wherein the tabs engage the light source.

7. The light source of claim 1, wherein said positioning member consists essentially of aluminum.

8. A lamp comprising:

a reflector housing including a nose;

a light source disposed in said reflector housing;

a pair of leads extending from said light source;

a positioning member including an opening, said positioning member receives said light source in the opening wherein said positioning member is adapted to be received in said reflector housing to axially align said light source in said reflector housing; and a shoulder disposed in said housing, said positioning member resting on said shoulder wherein said shoulder is adapted to vertically align said light source in said reflector housing, said shoulder extends upwardly from said nose such that said positioning member aligns said light source in said reflector housing with no greater force exerted by said positioning member on said shoulder than the weight of said positioning member and said light source.

9. The lamp of claim 8, wherein said reflector housing includes an opening and further comprising an eyelet protruding through an opening in the reflector housing, wherein the eyelet includes portions extending out of each side of the opening.

10. The lamp of claim 9, wherein said eyelet includes a flange that rests on a first side of said reflector housing and a swaged portion that engages a second side of said reflector housing.

11. A lamp comprising:

a reflector housing including a heel portion, a nose and a radial shoulder, the nose enclosing the heel portion and having an eyelet opening, the radial shoulder extending inwardly from the heel portion;

an eyelet received in the eyelet opening;

a positioning member including a light source opening, said positioning member contacting the shoulder;

a light source received in the light source opening;

a pair of leads extending from said light source, at least one lead being received by said eyelet, said eyelet being mechanically fastened to the at least one lead without the at least one lead being in tension.

12. The lamp of claim 11, wherein said eyelet includes a tubular portion having a first end, a second end and a flange at the first end of the tubular portion, wherein the tubular portion comprises a wall having a substantially uniform thickness from the first end to the second end.

13. The lamp of claim 11, wherein said eyelet includes a tubular portion and a flange, wherein the tubular portion has substantially homogenous strength characteristics throughout the length of the tubular portion.

14. A lamp comprising:

a reflector housing including reflective portion, a heel portion and a nose. wherein the nose includes an opening;

an eyelet including a tubular portion having a first end, a second end and a flange at the first end, said eyelet tubular portion protruding completely through the opening in the nose whereby the flange seats on a surface of the nose internal to the reflector housing;

a generally non-elastic positioning member disposed in the heel portion of said reflector housing and including an opening;

a light source having a lead connected thereto;

the light source disposed in the positioning member opening thereby positioning the light source in the reflector housing;

the light source lead extending through the eyelet tubular portion to the second end;

the eyelet mechanically fastened to the lead.

15. The lamp of claim 14 wherein the eyelet tubular portion has a substantially homogeneous strength characteristic therethrough.

16. The lamp of claim 14 wherein the tubular portion of the eyelet extending from the outer surface of the nose is deformed to fasten the eyelet to the outer surface of the nose.

17. The lamp of claim 14 further comprising a shoulder protruding inwardly from a wall of the heel portion, wherein the positioning member rests on the shoulder with a force no greater than the weight of the positioning member and the light source.

18. A lamp assembly including a reflector housing and a light source having leads mounted within the reflector housing, whereby the light source is axially, diametrically and vertically aligned within the housing without creating tension on the light source leads, wherein:

the reflector housing includes a reflective portion, a heel portion and a nose, wherein the nose includes an opening;

an eyelet including a tubular portion having a first end, a second end and a flange at the first end, protrudes completely through the opening in the nose whereby the flange seats on a surface of the nose internal to the reflector housing and the tubular portion of the eyelet extending from the outer surface of the nose is deformed to fasten the eyelet to the outer surface of the nose;

a generally non-elastic positioning member including an opening is disposed in the heel portion of said reflector housing;

said light source lead extends through the eyelet tubular portion to the second end; and said eyelet is mechanically fastened to said lead.

* * * * *